United States Patent [19]

Hosaka

[11] Patent Number: 4,928,654

[45] Date of Patent: May 29, 1990

[54] FUEL INJECTION CONTROL SYSTEM FOR AN AUTOMOTIVE ENGINE

[75] Inventor: Hiroshi Hosaka, Tokyo, Japan

[73] Assignee: Fuji Jukogyo Kabushiki Kaisha, Tokyo, Japan

[21] Appl. No.: 287,473

[22] Filed: Dec. 19, 1988

[30] Foreign Application Priority Data

Dec. 28, 1987 [JP] Japan ..... 62-332627

[51] Int. Cl.[5] ..... F02M 51/00

[52] U.S. Cl. ..... 123/486; 123/489; 123/480; 123/492

[58] Field of Search ..... 123/486, 489, 480, 488, 123/492, 493

[56] References Cited

U.S. PATENT DOCUMENTS 4,240,390 12/1980 Takada ..... 123/480

4,640,254 2/1987 Ninomiya ..... 123/486

4,662,339 5/1987 Hotate et al. ..... 123/486

4,730,590 3/1988 Sogawa ..... 123/486

4,741,312 5/1988 Ohishi ..... 123/489

4,785,785 11/1988 Oba et al. ..... 123/488

*Primary Examiner*—Raymond A. Nelli

*Attorney, Agent, or Firm*—Martin A. Farber

[57] ABSTRACT

The quantity of air inducted in a cylinder of an engine is estimated by using equations based on various coefficients. The coefficients are stored in a memory and derived in accordance with engine operating conditions. A basic injection pulse width is calculated by the estimated inducted air quantity and speed of the engine. The basic injection pulse width is corrected by a feedback coefficient, thereby producing a fuel injection pulse width signal for operating a fuel injector of the engine.

8 Claims, 3 Drawing Sheets

FUEL INJECTION CONTROL SYSTEM FOR AN AUTOMOTIVE ENGINE

BACKGROUND OF THE INVENTION

The present invention relates to a system for controlling the fuel injection of an automotive engine in dependency on a throttle opening degree and engine speed.

In a known fuel injection system, a basic fuel injection pulse width Tp is calculated in dependency on throttle opening degree $\alpha$ and engine speed Ne. The basic pulse width Tp is stored in a table and is derived from the table for controlling the fuel injection during the operation of the engine.

At a transient state of the operation of the engine, the basic fuel injection pulse width Tp is corrected in dependency on various factors such as engine speed, pressure in an intake passage, coolant temperature and vehicle speed, so that air-fuel mixture is prevented from becoming rich or lean (see for example, Japanese Patent Laid Open Nos. 58-48720 and 58-41230).

However, since there is a space between the throttle valve and the cylidners of the engine, such as a chamber formed downstream of the throttle valve, changing of the actual amount of inducted air per engine cycle in response to the change of the throttle opening degree during the transient state is delayed. Accordingly, when the throttle valve is rapidly opened, the air-fuel mixture becomes rich. To the contrary, when the throttle valve is rapidly closed, the air-fuel ratio becomes lean.

In order to overcome such a defect, it is preferable to infer the quantity of the air inducted in the cylinder of the engine in one cycle in accordance with a model equation and to correct the basic injection pulse width based on the estimated quantity.

SUMMARY OF THE INVENTION

The object of the present invention is to provide a system for controlling the fuel injection where the air-fuel mixture is prevented from becoming rich or lean during transient states and kept at an optimum air-fuel ratio.

In accordance with the present invention, the quantity of air inducted in a cylinder of an engine is estimated by using equations based on various coefficients. The coefficients are stored in a memory and derived from the table in accordance with engine operating conditions.

A basic injection pulse width is calculated by the estimated inducted air quantity and speed of the engine.

According to the present invention, there is provided a system for controlling fuel injection of an engine for a motor vehicle having an intake passage, a throttle valve provided in the intake passage, and a fuel injector. The system comprises an engine speed sensor producing an engine speed signal dependent on speed of the engine, sensing means for sensing engine operating conditions and for producing engine operating condition signals, storing means for storing various coefficients which are arranged in accordance with the engine speed signal and the engine operating condition signals and used for an equation for estimating the quantity of air inducted in a cylinder of the engine, estimating means for estimating the inducted air quantity in accordance with the equation, based on coefficients derived from the storing means in accordance with the engine operating condition signals, and calculator means for producing a basic injection pulse width signal in accordance with the estimated inducted air quantity and the engine speed signal.

The other objects and features of this invention will become understood from the following description with reference to the accompanying drawings.

DETAILED DESCRIPTION OF THE PREFERRED EMBODIMENT

Figures 1, 2:
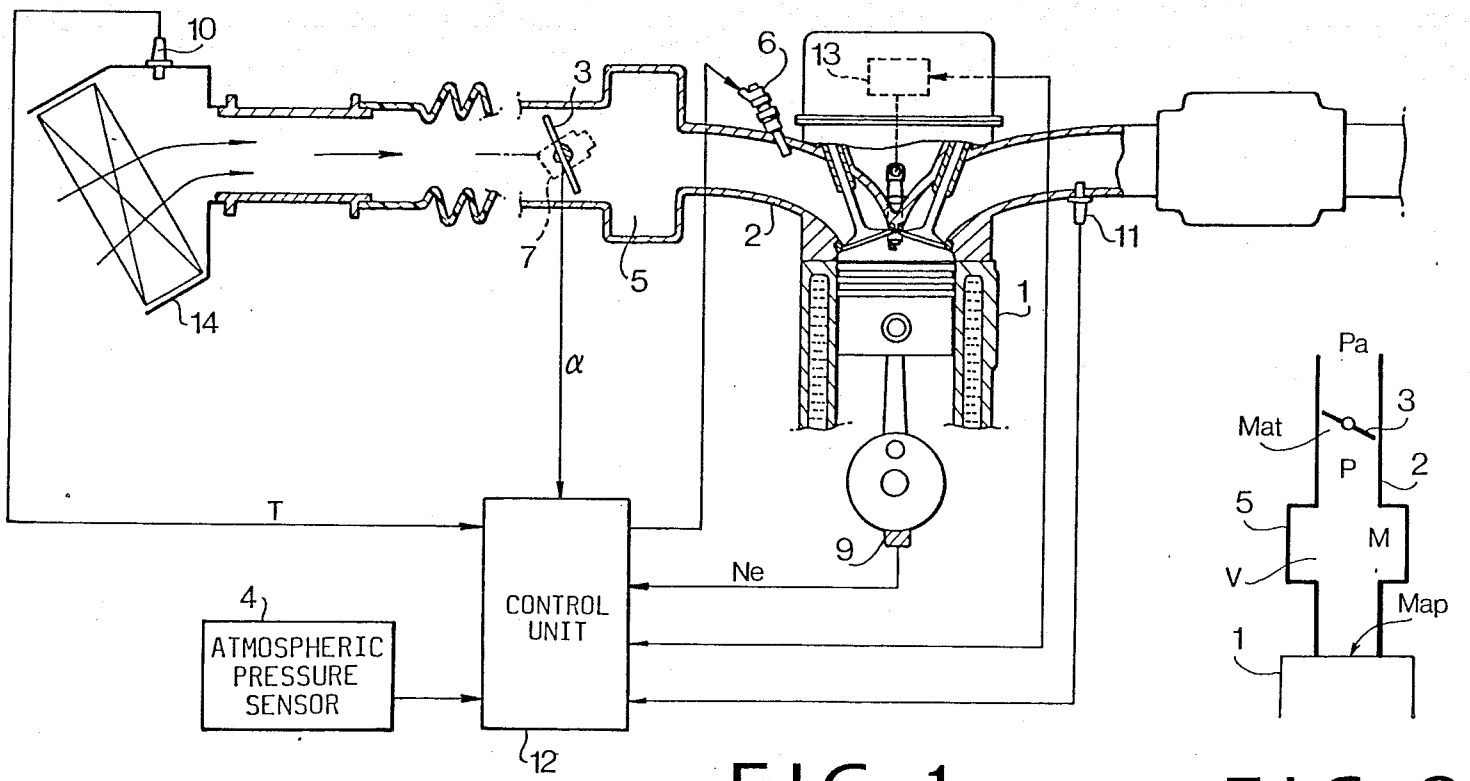
FIG. 1 is a schematic diagram showing a system according to the present invention.
FIG. 2 is a schematic view of an intake system, for explaining various factors.
Figure 4:
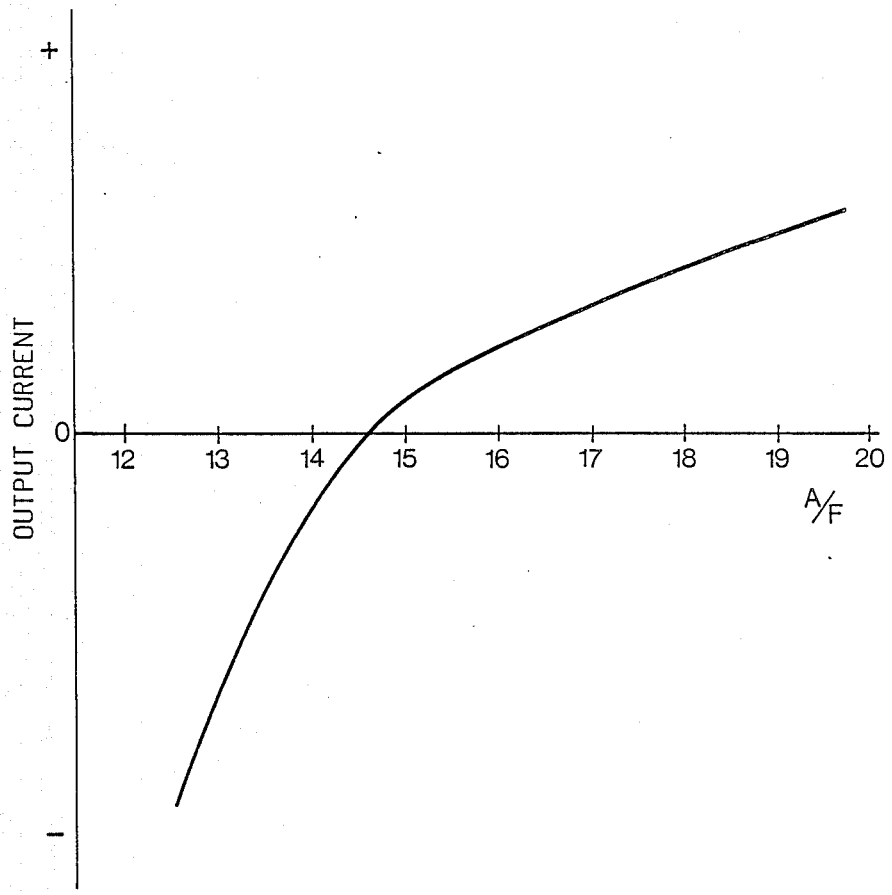
FIG. 4 is a graph showing a characteristic of an output signal of an $O_2$-sensor.

Referring to FIG. 1, in an intake passage 2 of an engine 1, a throttle chamber 5 is provided downstream of a throttle valve 3 so as to absorb the pulsation of intake air. Multiple fuel injectors 6 are provided in the intake passage at positions adjacent intake valves of the engine so as to supply fuel to each cylinder of the engine 1. A position sensor 7 is provided on the throttle valve 3. An engine speed sensor 9 is provided on the engine 1. An intake air temperature sensor 10 is provided on an air cleaner 14 and an atmospheric pressure sensor 4 is provided. An $O_2$-sensor 11 having a characteristic shown in FIG. 4 is provided in an exhaust passage from the engine. Output signals of the sensors for detecting respective conditions are applied to a control unit 12 comprising a microcomputer to operate the fuel injectors 6 and an ignition coil 13.

The quantity map of the air inducted in the cylinder is estimated based on a model of the intake system as shown in FIG. 2.

In FIG. 2, Pa designates the atmospheric pressure, $\rho$ a is the density of the atmosphere, Map is the quantity of the air inducted in the cylinder of the engine 1, Mat is the quantity of the air passing the throttle valve 3, P is the pressure in the intake passage 2, V is the capacity of the intake passage, and M is the quantity of the air in the intake passage.

The quantity of accumulated air is represented as $$dM/dt = \mathrm{Mat} - \mathrm{Map} \tag{1}$$

The equation of state is $$PV = MRT \tag{2}$$

The quantity of the air inducted in the cylinder Map is $$\mathrm{Map} = (Ne \cdot D/2RT) \cdot \eta v \cdot p \tag{3}$$

The quantity of the air passing the throttle valve Mat is $$Mat = C \cdot A \cdot \psi \cdot \sqrt{Pa \cdot \rho a} \tag{4}$$

In this case, when $P/Pa > \{2/(k+1)\}^{k/(k-1)}$, $$\psi = \sqrt{2gk/(k-1)\,[(P/Pa)^{2/k} - (P/Pa)^{(k+1)/k}]}$$

and when $P/Pa < \{2/(k+1)\}^{k/(k-1)}$, $$\psi = \sqrt{2gk/(k+1)\{2/(k+1)\}^{2/(k-1)}}.$$

The air flow sectional area A is $$A = a + b(1 - \cos(\alpha + \alpha o)/\cos\alpha o) \quad (5)$$

where $\alpha$ is the throttle valve opening degree, Ne is the engine speed, D is the displacement, $\eta v$ is the volumetric efficiency, C is the coefficient for the quantity of air passing the throttle valve, R is the gas constant, K is the specific heat ratio, g is the gravitational acceleration, T is the intake air temperature, a is the bypass passage sectional area, b is the sectional area of the intake passage, and $\alpha o$ is the throttle plate angle to the section of the intake passage at the closed throttle valve. Here, Map is determined on taking account of the quantity of the air passing the bypass around the throttle valve. Taking the derivative of equation (2) and substituting the above equation (1) and (3), $$dP/dt = (RT/V)\cdot \mathrm{Mat} - (D/2V)\cdot \mathrm{Ne}\cdot \eta v\cdot P$$

Discreting this equation, $$\{P(k+1) - P(k)\}/\Delta t = (RT/V)\cdot \mathrm{Mat}(k) - (D/2V)\cdot \mathrm{Ne}(k)\cdot \eta v(k)\cdot P(k)$$

(where $\Delta t$ is sampling cycle)

$$P(k+1) = K_1\cdot \mathrm{Mat}(k) + K_2\cdot P(k) \quad (6)$$

$$\mathrm{Mat}(k) = C\cdot A\cdot B\{P(k)\} \quad (7)$$

$$\mathrm{Map}(k) = K_3\cdot K_4\cdot P(k) \quad (8)$$

where $K_1 = (RT/V)\cdot \Delta t$, $K_2 = 1 - (D/2V)\cdot \mathrm{Ne}(k)\cdot \eta v(k)\cdot \Delta t$, $K_3 = D/2RT$, $$B = \psi\sqrt{Pa\cdot \rho a}, \text{ and } K_4 = Ne(k)\cdot \eta v(k).$$

In order to determine Map from the model equations, each of the coefficients must be set.

Figure 3:
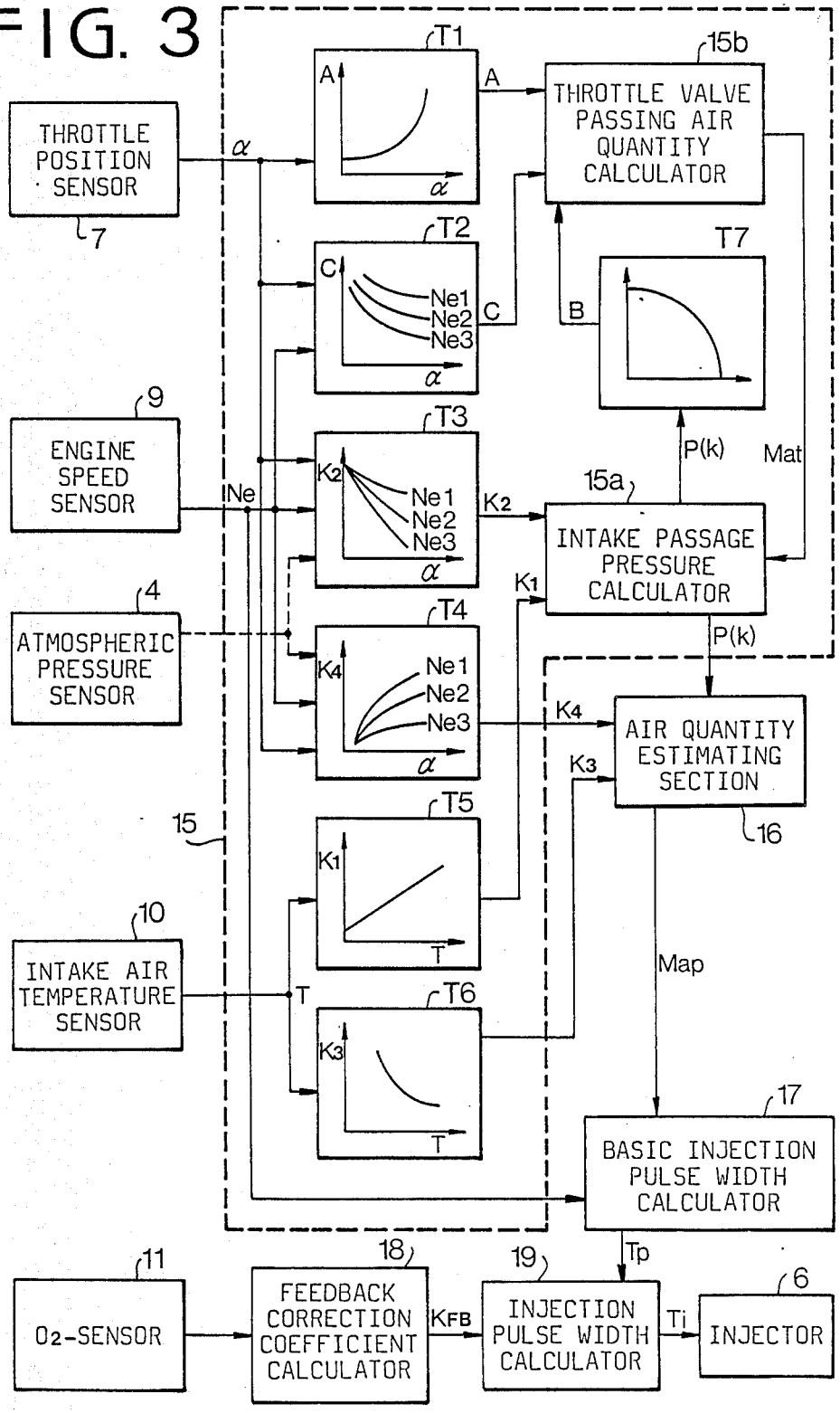
FIG. 3 is a block diagram showing a control unit of the present invention.

Referring to FIG. 3, the control unit 12 comprises a ROM which has tables T1 to T7 storing respective coefficients for the discreted model equations. Each coefficient is derived in accordance with engine operating conditions detected by respective sensors, namely, the engine speed Ne, throttle opening degree $\alpha$ and intake air temperature T. The area A is derived from Table T1 in accordance with the throttle valve opening degree $\alpha$. In accordance with the throttle opening degree $\alpha$ and the engine speed Ne, the coefficient C is derived from table $T_2$, the coefficient $K_2$ is derived from table $T_3$, and the coefficient $K_4$ is derived from table $T_4$. In accordance with the intake air temperature T, the coefficient $K_1$ is derived from Table $T_5$ and the coefficient $K_3$ is derived from table $T_6$. These coefficients are employed as operators of the model equations at that time. An air quantity estimating section 16 is provided for estimating the quantity of the air Map from the model equation in accordance with coefficients $K_3$ and $K_4$ derived from the tables $T_6$ and $T_4$. The control unit 12 further has a basic fuel injection pulse width calculator 17 for calculating a basic injection pulse width Tp in accordance with the air quantity Map from the section 16 and the engine speed Ne, a feedback correction coefficient calculator 18 for calculating a feedback correction coefficient $K_{FB}$ based on an output voltage of the $O_2$ sensor 11, and a fuel injection pulse width calculator 19 which is applied with the basic injection pulse width Tp and the correction coefficient $K_{FB}$ for correcting basic injection pulse width Tp in accordance with the coefficient $K_{FB}$ and calculates a fuel injection pulse width Ti.

An intake passage pressure calculator 15a and a throttle valve passing air quantity calculator 15b are provided. The intake passage pressure calculator 15a is applied with coefficients $K_1$ and $K_2$ and the throttle valve passing air quantity Mat, and the intake passage pressure is calculated by the following equation.

$$P(k+1) = K_1\cdot \mathrm{Mat}(k) + K_2\cdot P(k)$$

The value P(k) is applied to table $T_7$ to derive the coefficient B which is applied to the throttle valve passing air quantity calculator 15b. The calculator 15b is further applied with coefficients A and C, and calculates the air quantity Mat by using the equation Mat=C·A·B. The intake passage pressure P(k) and the coefficients $K_3$ and $K_4$ are applied to the air quantity estimating section 16 where the quantity of the air Map inducted in the cylinder is estimated by the following model equation.

$$\mathrm{Map}(k) = K_3\cdot K_4\cdot P(k)$$

In the basic fuel injection pulse width calculator 17, the basic fuel injection pulse width Tp is derived from the table in accordance with the quantity of the air Map(k) and the engine speed Ne. In the feedback correction coefficient calculator 18, the feedback correction coefficient $K_{FB}$ is calculated in dependency on the output voltage of the $O_2$ sensor 11. The basic fuel injection pulse width Tp and the feedback correction coefficient $K_{FB}$ are applied to the injection pulse width calculator 19 where the injection pulse width Ti is calculated by the following equation.

$$\mathrm{Ti} = \mathrm{Tp}\cdot K_{FB}$$

The pulse width Ti is applied to the injectors 6 for injecting the fuel.

In the above described embodiment, coefficients $K_2$ and $K_4$ including the volumetric efficiency $\eta v$ are derived in accordance with only the throttle valve opening degree $\alpha$ and the engine speed Ne. However, coefficients $K_2$ and $K_4$ can be derived from a table of a multidimension which is provided by exactly calculating the volumetric efficiency $\eta v$ in accordance with a factor of the intake air temperature T or the atmospheric pressure Pa.

In accordance with the present invention, the quantity of the air is estimated by model equations and each of the coefficients for the model equations is previously determined. Accordingly, an optimum air-fuel ratio is provided for preventing the air-fuel mixture from becoming rich or lean, thereby improving driveability of the automobile. Further, concentrations of CO and NOx in the emission can be reduced.

While the presently preferred embodiment of the present invention has been shown and described, it is to be understood that this disclosure is for the purpose of illustration and that various changes and modifications may be made without departing from scope of the invention as set forth in the appended claims.

What is claimed is:

1. A system for controlling fuel injection of an engine for a motor vehicle having an intake system comprising an intake passage, a throttle valve provided in the intake passage, and a fuel injector, the controlling system comprising engine speed detector means for detecting engine speed and for producing an engine speed signal;

throttle position detector means for detecting throttle position and for producing a throttle position signal, intake air temperature detector means for detecting intake air temperature and for producing an intake air temperature signal, first calculator means responsive to the engine speed signal, throttle position signal and intake air temperature signal for calculating pressure in the intake passage pressure based on a model equation of the intake system representing fluctuation of the intake passage pressure as a function of variations of the engine speed, throttle position and intake air temperature and for producing an intake passage pressure signal corresponding to the calculated intake passage pressure, second calculating means responsive to the engine speed signal, throttle position signal, intake air temperature signal and intake passage pressure signal for calculating an engine inducted air quantity in accordance with an equation of state of fluid in the intake passage and for producing an inducted air quantity signal corresponding to the calculated engine inducted air quantity, and third calculator means responsive to the engine speed signal and inducted air quantity signal for calculating an injection pulse width to inject an optimum amount of fuel from the injector.

2. The system for controlling fuel injection according to claim 1, further comprises a throttle valve passing air quantity calculator means responsive to the engine speed signal, throttle position signal, and intake passage pressure signal for calculating a throttle valve passing air quantity and for producing a corresponding throttle valve air passing quantity signal, and said first calculator means is further responsive to said throttle valve passing air quantity signal.

3. The system for controlling fuel injection according to claim 1, wherein said first calculator means is further responsive to atmospheric pressure.

4. The system for controlling fuel injection according to claim 1, wherein said model equation is $$dp/dt=(RT/V)\ \mathrm{Mat}-(D/2V)\ \mathrm{Ne}\ \eta v\ P,$$

where R is the universal gas constant, P is intake passage pressure, T is intake air temperature, Mat is the quantity of air passing the throttle valve, D is engine cylinder displacement, V is capacity of the intake passage, Ne is engine speed and $\eta$v is volumetric efficiency.

5. The system for controlling fuel injection according to claim 4, wherein the equation of state is PV=MRT, where M the quantity air in the intake passage.

6. The system for controlling fuel injection according to claim 1, wherein the engine inducted air quantity is calculated by said third calculator means by making the calculation Ne D/2RT $\eta$v P, where R is the universal gas constant, P is intake passage pressure, T is intake air temperature, D is engine cylinder displacement, Ne is engine speed and $\eta$v is volumetric efficiency.

7. The system for controlling fuel injection according to claim 4, wherein the engine inducted air quantity is calculated by said third calculator means by making the calculation Ne D/2RT $\eta$v P.

8. The system for controlling fuel injection according to claim 2, wherein said throttle valve passing air quantity calculator means calculates the throttle valve passing air quantity by making the calculation CAB, wherein C is a coefficient for quantity of air passing the throttle valve, A is air flow sectional area dependent on the throttle valve position signal and B is a coefficient dependent on specific heat, density of atmospheric pressure, gravitational acceleration and the intake passage pressure.

* * * * *